US007726710B2

(12) United States Patent
Handwerker

(10) Patent No.: US 7,726,710 B2
(45) Date of Patent: Jun. 1, 2010

(54) COVER AND METHOD OF USE

(75) Inventor: Gary Handwerker, Northfield, IL (US)

(73) Assignee: Midwest Canvas Corporation, Chicago, IL (US)

( * ) Notice: Subject to any disclaimer, the term of this patent is extended or adjusted under 35 U.S.C. 154(b) by 0 days.

(21) Appl. No.: 11/970,419

(22) Filed: Jan. 7, 2008

(65) Prior Publication Data

US 2009/0173460 A1 Jul. 9, 2009

(51) Int. Cl.
*B66C 1/12* (2006.01)

(52) U.S. Cl. ..... 294/1.1; 294/74

(58) Field of Classification Search ..... 294/1.1, 294/74, 152, 156, 157; 56/329; 5/625–627
See application file for complete search history.

(56) References Cited

U.S. PATENT DOCUMENTS

| | | | | | |
|---|---|---|---|---|---|
| 732,838 | A * | 7/1903 | Edwards | 294/152 |
| 816,186 | A * | 3/1906 | Roberts | 56/329 |
| 2,749,957 | A * | 6/1956 | Smith | 294/150 |
| 3,785,451 | A | 1/1974 | McCord | 180/69.1 |
| 3,792,806 | A * | 2/1974 | Layton | 294/152 |
| 3,987,592 | A | 10/1976 | Herminghaus et al. | 52/3 |
| 4,519,183 | A | 5/1985 | Parody | 53/461 |
| 4,682,447 | A | 7/1987 | Osborn | 52/3 |
| 5,050,924 | A | 9/1991 | Hansen | 296/100 |
| D327,345 | S * | 6/1992 | Lammon et al. | D34/1 |
| 5,178,426 | A * | 1/1993 | David et al. | 294/1.3 |
| 5,660,402 | A | 8/1997 | Jones et al. | 280/19 |
| 5,978,989 | A * | 11/1999 | Chavez | 5/627 |
| 6,276,698 | B1 | 8/2001 | Calandra | 280/19 |
| 6,758,596 | B2 * | 7/2004 | McDonough | 383/4 |
| 7,025,402 | B2 | 4/2006 | Remmel | 296/100.12 |
| 7,216,908 | B2 * | 5/2007 | Daigle | 294/74 |
| 7,249,792 | B1 | 7/2007 | Bunten | 294/1.1 |

OTHER PUBLICATIONS

Sugar House Awning & Canvas Products Snow Tarp Specifications Sheet, Oct. 25, 2007.

* cited by examiner

*Primary Examiner*—Dean J Kramer
(74) *Attorney, Agent, or Firm*—J. Peter Paredes; Rosenbaum & Silvert, P.C.

(57) ABSTRACT

Embodiments described herein provide a cover, and a method for using the cover with a surface. One embodiment of the cover comprises a flexible, substantially planar member. A plurality of reinforcing members is attached to the flexible, substantially planar member. The plurality of reinforcing members is arranged on the flexible, substantially planar member so that the flexible, substantially planar member can reliably support a load. A plurality of manipulation members is operatively associated with the plurality of reinforcing members. The plurality of manipulation members is accessible to a lifter so that the lifter can apply force to the plurality of reinforcing members and can move the load reliably supported by the flexible, substantially planar member. In a method of using a cover with a surface, a cover having a flexible, substantially planar member, a plurality of reinforcing members attached to the flexible, substantially planar member, the plurality of reinforcing members being arranged on the flexible, substantially planar member so that the flexible, substantially planar member can reliably support a load, and a plurality of manipulation members operatively associated with the plurality of reinforcing members is provided. The cover is placed on the surface. The load is allowed to accumulate on the cover. The plurality of manipulation members is accessed with a lifter. A force is applied to the plurality of reinforcing members with the lifter. The load reliably supported by the flexible, substantially planar member is moved with the lifter.

18 Claims, 4 Drawing Sheets

COVER AND METHOD OF USE

BACKGROUND

Disclosed herein are a number of embodiments of a cover. Also disclosed are methods of using a cover.

In many disciplines, such as the construction field and the like, a work area including a work surface is involved. The work surface may be outdoors, and may be susceptible to many factors like snow, ash and other complicating materials, falling upon the work surface. In the case of snow, the work surface, periodically, may be covered with a layer of snow. This layer may be inches thick, thereby making further work more complicated or dangerous. Sometimes, work may be halted until the layer of snow is removed from the work surface. Snow removal takes time and effort and is costly. The time it takes to remove the snow from the work surface is time that could be spent working. Thus, snow removal not only costs time and money, but also results in lost work time. It is desirable to provide a reliable way of removing the layer of snow from a work surface in a timely, cost effective fashion.

SUMMARY

Embodiments described herein provide a cover, and a method for using the cover with a surface. One embodiment of the cover comprises a flexible, substantially planar member. A plurality of reinforcing members is attached to the flexible, substantially planar member. The plurality of reinforcing members is arranged on the flexible, substantially planar member so that the flexible, substantially planar member can reliably support a load. A plurality of manipulation members is operatively associated with the plurality of reinforcing members. The plurality of manipulation members is accessible to a lifter so that the lifter can apply force to the plurality of reinforcing members and can move the load reliably supported by the flexible, substantially planar member.

Another embodiment of a cover comprises a flexible, substantially planar member, a plurality of reinforcing members attached to the flexible, substantially planar member, the plurality of reinforcing members being arranged on the flexible, substantially planar member so that the flexible, substantially planar member can reliably support a load, and a plurality of manipulation members operatively associated with the plurality of reinforcing members, the plurality of manipulation members being accessible to a lifter so that the lifter can apply force to the plurality of reinforcing members and move the load reliably supported by the flexible, substantially planar member.

In a method of using a cover with a surface, a cover having a substantially flexible, substantially planar member, a plurality of reinforcing members attached to the flexible, substantially planar member, the plurality of reinforcing members being arranged on the flexible, substantially planar member so that the flexible, substantially planar member can reliably support a load, and a plurality of manipulation members operatively associated with the plurality of reinforcing members is provided. The cover on is placed on the surface. The load is allowed to accumulate on the cover. The plurality of manipulation members is accessed with a lifter. A force is applied to the plurality of reinforcing members with the lifter. The load reliably supported by the flexible, substantially planar member is moved with the lifter.

In another method of using a cover with a surface, a cover having a flexible, substantially planar member, a plurality of reinforcing members attached to the flexible, substantially planar member, the plurality of reinforcing members being arranged on the flexible, substantially planar member so that the flexible, substantially planar member can reliably support a load, and a plurality of manipulation members operatively associated with the plurality of reinforcing members is provided. The cover is placed on the surface. The load is allowed to accumulate on the cover. A subset of the plurality of manipulation members is accessed with a lifter. A force is applied to the subset of the plurality of reinforcing members with the lifter. The load is redistributed on the flexible, substantially planar member with the lifter.

DETAILED DESCRIPTION

Figure 1:
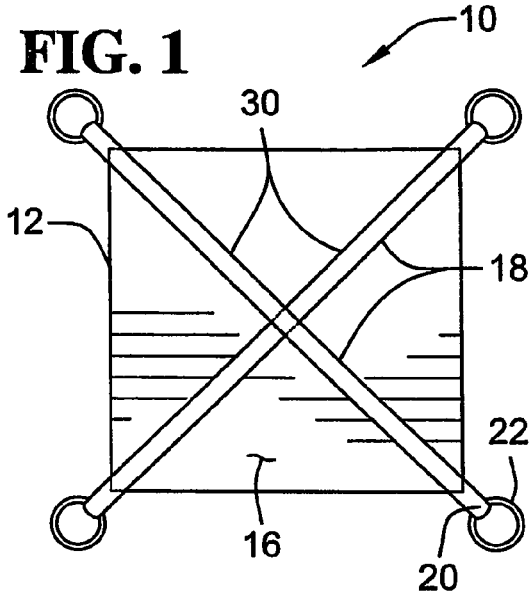
FIG. 1 is a bottom view of a embodiment of a cover described herein.
Figure 2:
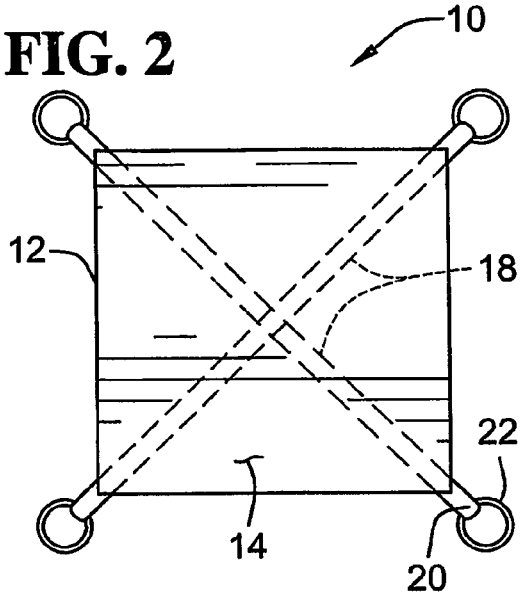
FIG. 2 is a top view of the cover of FIG. 1.
Figure 5:
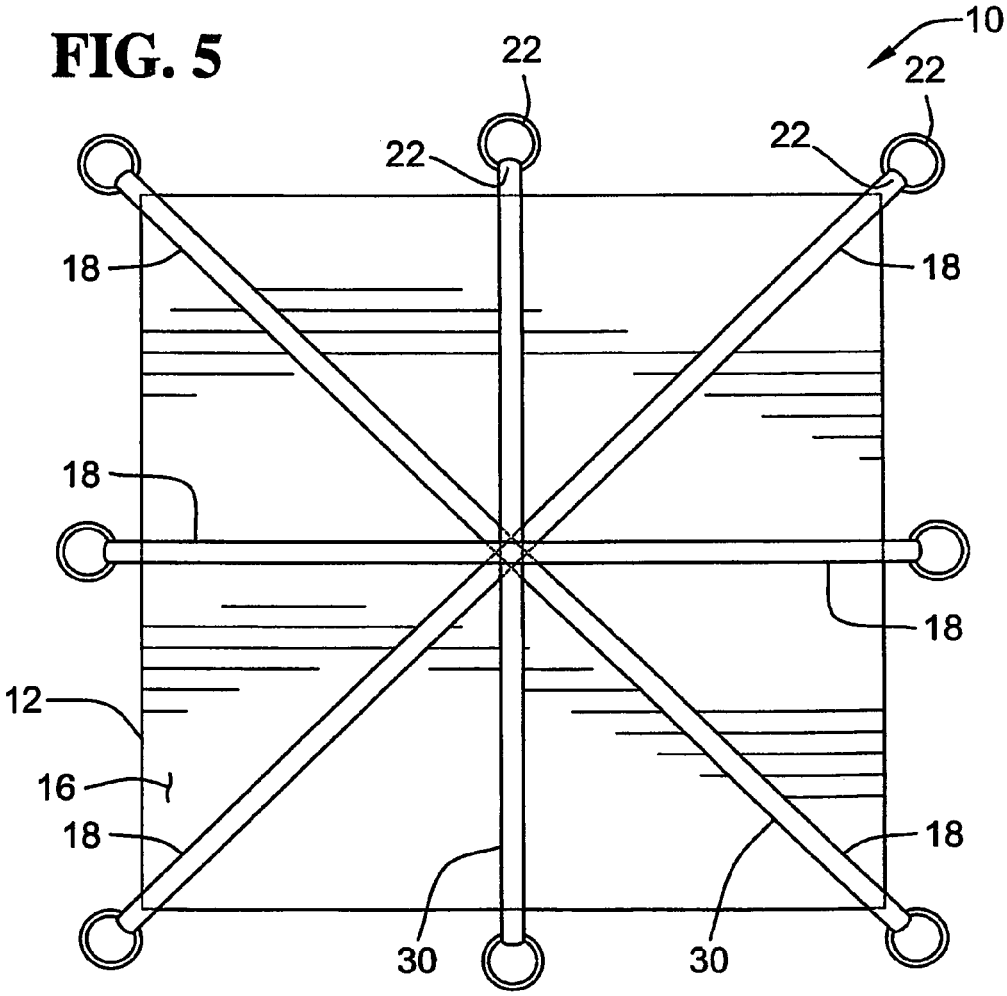
FIG. 5 is a bottom view of a further embodiment of a cover described herein.

The FIGS. 1 through 9 show a number of embodiments of a cover 10 that can be placed over a surface, such as a work surface in a work area, a driveway and the like. Construction of each of the embodiments is substantially similar. Hence, like reference numerals are used for substantially similar elements. The cover 10 generally comprises a flexible, substantially planar member 12. The flexible, substantially planar member 12 has a top side 14 and a bottom side 16. The bottom side 16 is intended to be placed upon a surface. The top side 14 is exposed and is intended to contact a load to be supported by the flexible, substantially planar member 12.

The flexible, substantially planar member 12 may be of any shape, such as polygonal (FIGS. 1 through 7), elliptical (FIG. 8), circular (FIG. 9) and the like. Both the top side 14 and the bottom side 16 are substantially smooth. In a preferred embodiment, the flexible, substantially planar member 12 is substantially square shaped or substantially circularly shaped. Some embodiments of the cover 10, such as the embodiments shown in FIGS. 1 through 4, can define either a 16 foot square or a 20 foot square, while other embodiments, such as those shown in FIGS. 5 and 6, can define either a 20 foot square or a 24 foot square. These substantially square shapes of the flexible, substantially planar member 12 facilitate reliable support of a load, such as snow or the like, disposed on the top side 14 of the flexible, substantially planar member 12, and thereby facilitate movement of the cover 10 and the load. Reliable support means that the flexible, substantially planar member 12 supports the load in a manner such that a significant amount of the load does not move or spill off of the top side 14 of the flexible, substantially planar member 12 and the flexible, substantially planar member 12 does not fail or tear under strain of supporting the load. While being reliably supported, an insignificant amount of the load may move or spill off of the top side 14 of the flexible, substantially planar member 12. The flexible, substantially planar member 12 can be made of any suitable water proof or water repellent material or mesh, such as 13 oz. material, ideal for the embodiments of FIGS. 1 through 4, or 18 oz. material, ideal for the embodiments of FIGS. 5 and 6.

All of the embodiments of the cover 10 include a plurality of reinforcing members 18 attached to the bottom side 16 of the flexible, substantially planar member 12. The reinforcing member 18 may be substantially strap-like in shape, and traverse the bottom side 16 of flexible, substantially planar member 12 in a substantially criss-cross like fashion. The reinforcing members 18 are connected to the flexible, substantially planar member 12 by any suitable means. Preferably, the reinforcing members 18 are connected with the flexible, substantially planar member 12 by stitching. The reinforcing members 18 traverse the bottom side 16 of the flexible, substantially planar member 12 to add strength to the flexible, substantially planar member 12 so that a load can be reliably supported by the flexible, substantially planar member 12. Accordingly, the reinforcing members 18 are disposed on the bottom side 16 of the flexible, substantially planar member 12 to minimize an unsupported region of the flexible, substantially planar member 12. The reinforcing members 18 traverse substantially an entire area of the bottom side 16 of the flexible, substantially planar member 12 to increase the ability of the flexible, substantially planar member 12 to reliably support a load. The reinforcing members 18 may be continuous, or may comprise discontinuous pieces that are connected to each other. The reinforcing members 18 may be formed of any suitable material. Preferably, the reinforcing members 18 comprise 6000 lb. webbing.

Each portion 20 of the reinforcing members 18 that extends beyond a boundary of the flexible substantially planar member 12 is connected with a manipulation member 22. Preferably, the manipulation members 22 are disposed substantially equidistantly from a center of the flexible, substantially planar member 12 to provide reliable support to the load supported by the flexible, substantially planar member 12. Substantially square or substantially circular shapes of the flexible, substantially planar member 12 (FIGS. 1 through 6 and 9) provide some examples of these preferred embodiments. In other embodiments, the manipulation members 22 are disposed at varying distances from a center of the flexible, substantially planar member 12. Substantially rectangular or substantially elliptical shapes of the flexible, substantially planar member 12 (FIGS. 7 and 8) provide some examples of these embodiments. These embodiments may provide reliable support that is less than the reliable support provided by the substantially square or substantially circular embodiments. However, any movement or spillage of load from the flexible, substantially planar member 12 is not significant. In some embodiments, the manipulation member 22 is substantially ring shaped, and the portion 20 extends through a center of the manipulation member 22, wraps back around the manipulation member 22 and is secured to the same reinforcing member 18 at the bottom side 16 of the flexible, substantially planar member 12. In this fashion, the reinforcing members 18 provide reliable force transmission from the manipulation member 22 to the flexible, substantially planar member 12, thereby facilitating movement of the flexible, substantially planar member 12 and the load reliably supported thereby. In a preferred embodiment, the manipulation member 22 comprises a 4" diameter bull ring. As the cover 10 comprises a plurality of reinforcing members 18, the cover 10 comprises a like number of portions 20 and manipulation members 22. The manipulation members 22, the reinforcing members 18 and the portions 20, are distributed substantially equidistantly on the flexible, substantially planar member 12 to increase reliable support of the load. This substantially equidistant distribution tends to distribute weight substantially evenly among the reinforcing members 18, the portions 20 and the manipulation members 22 when the cover 10 is moved.

Figure 3:
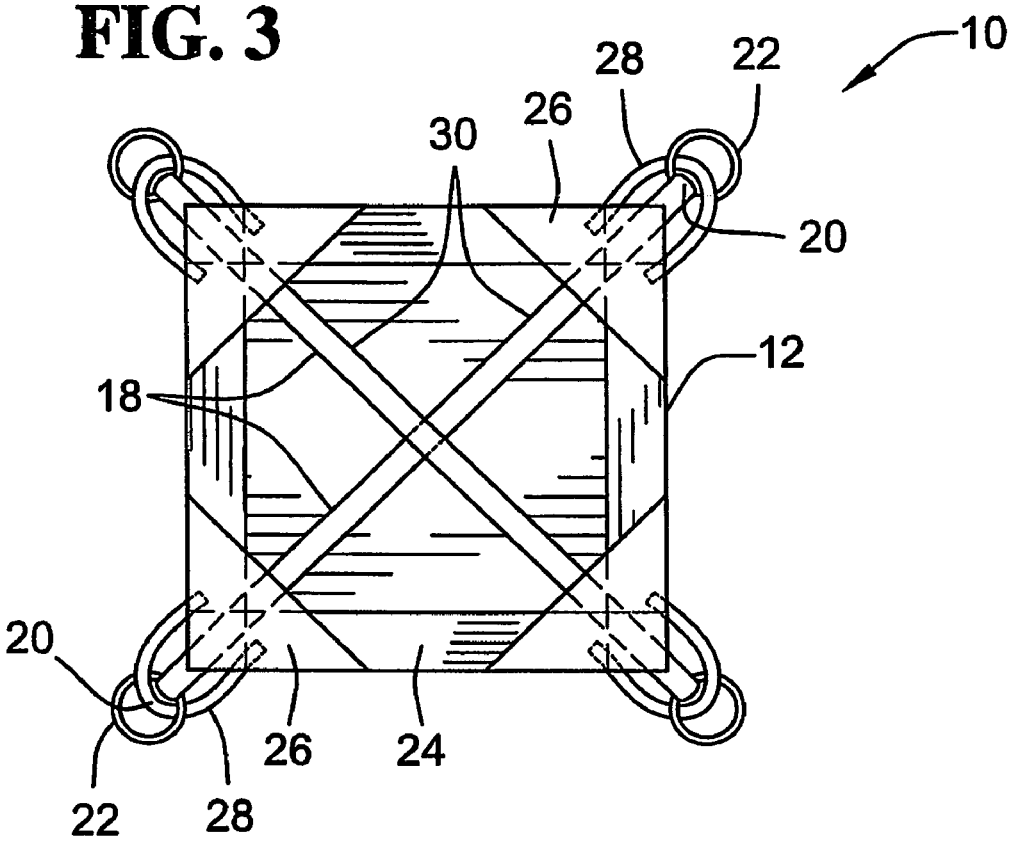
FIG. 3 is a bottom view of another embodiment of a cover described herein.
Figure 4:
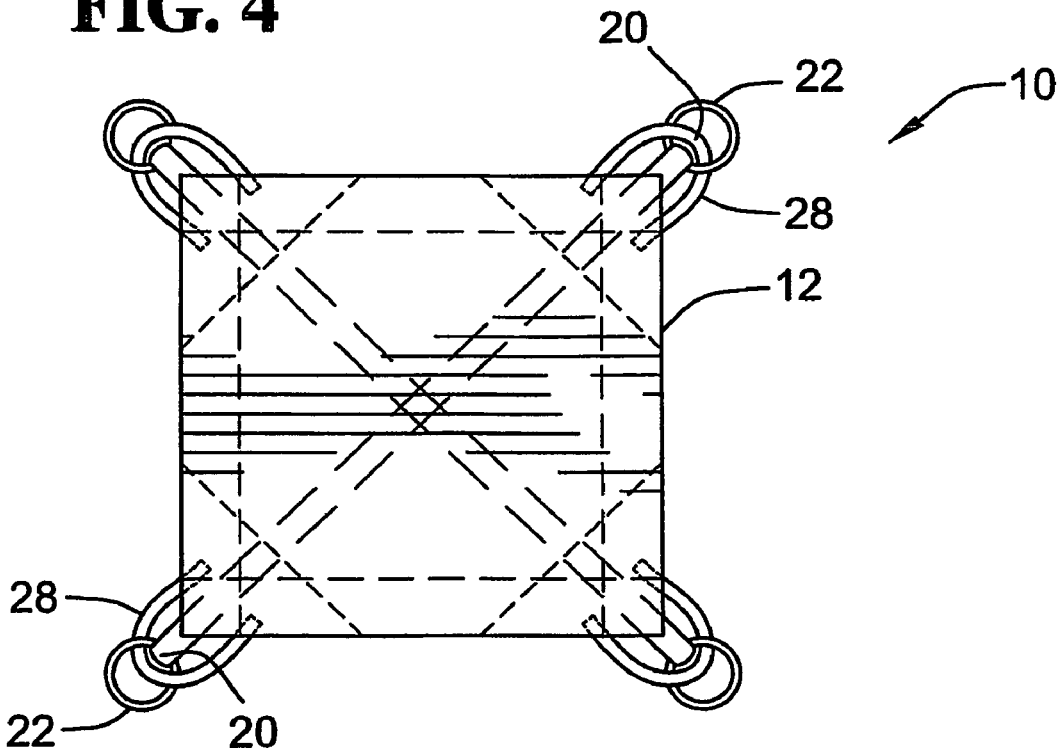
FIG. 4 is a top view of the cover of FIG. 3.
Figure 6:
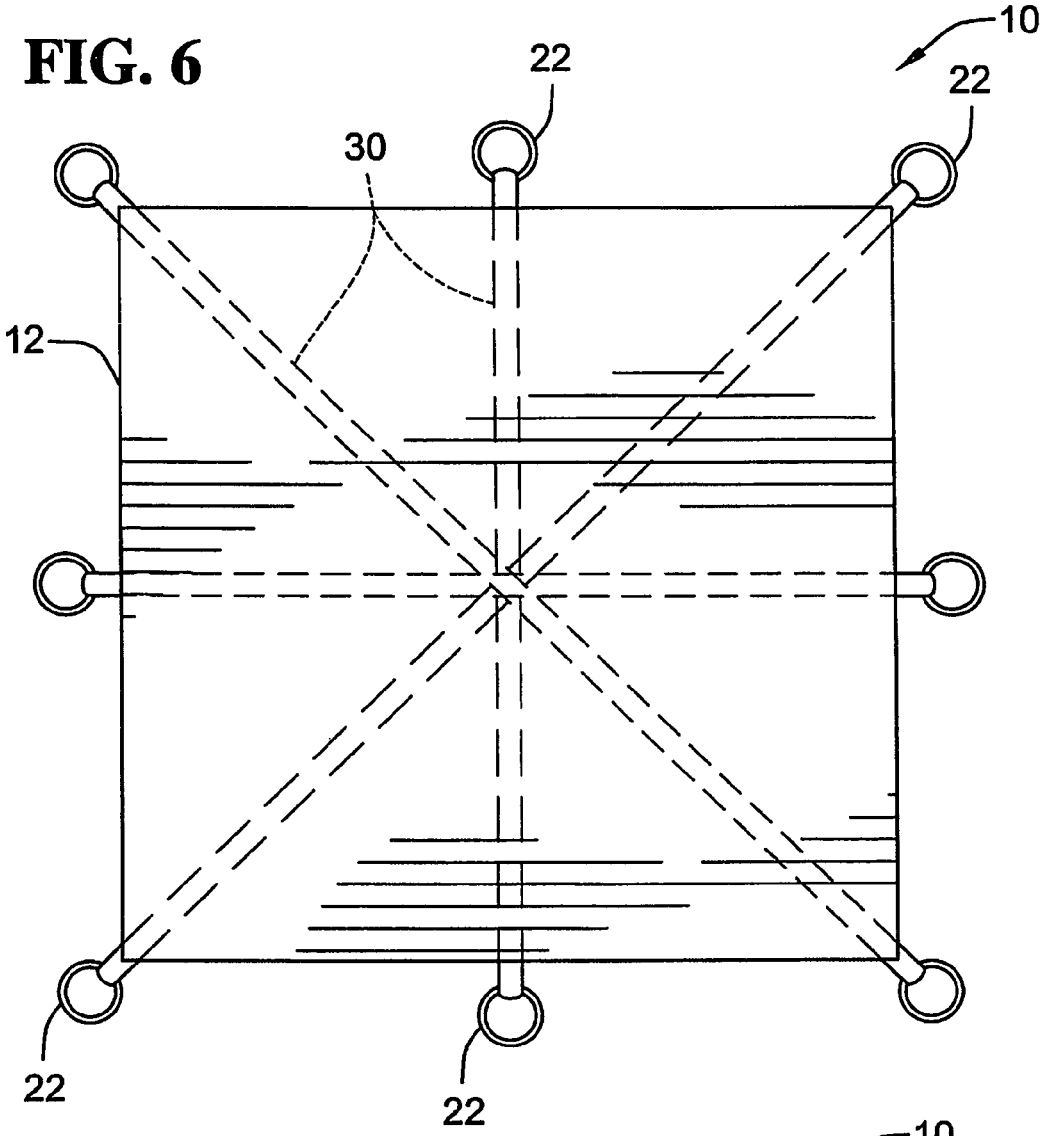
FIG. 6 is a top view of the cover of FIG. 5.
Figure 7:
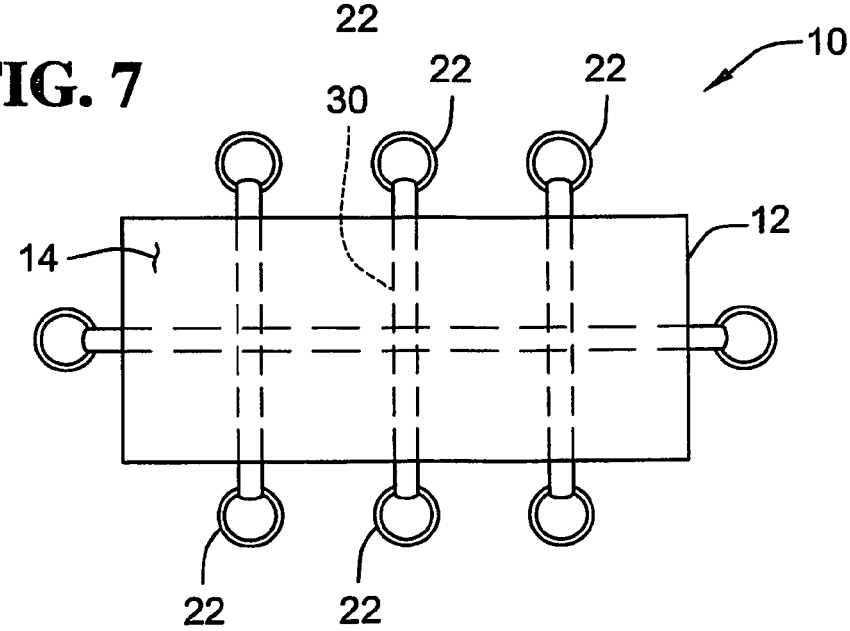
FIG. 7 is a top view of another embodiment of a cover described herein.
Figure 8:
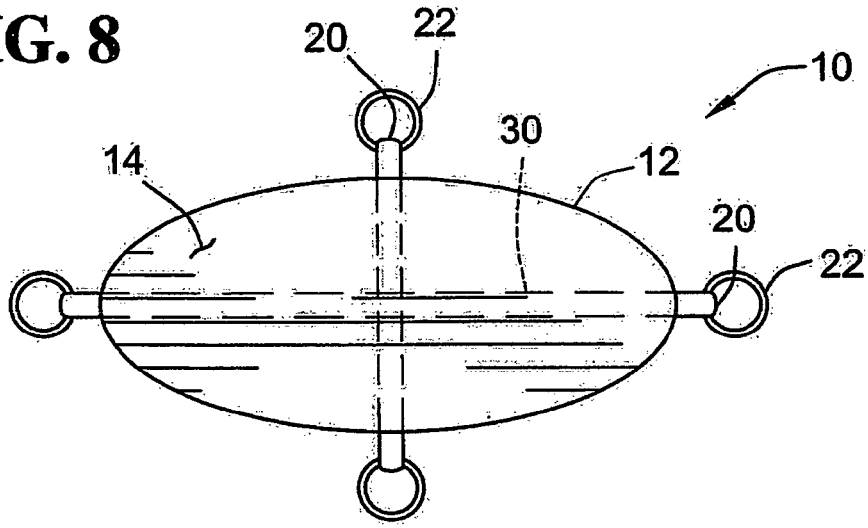
FIG. 8 is a top view of another embodiment of a cover described herein.
Figure 9:
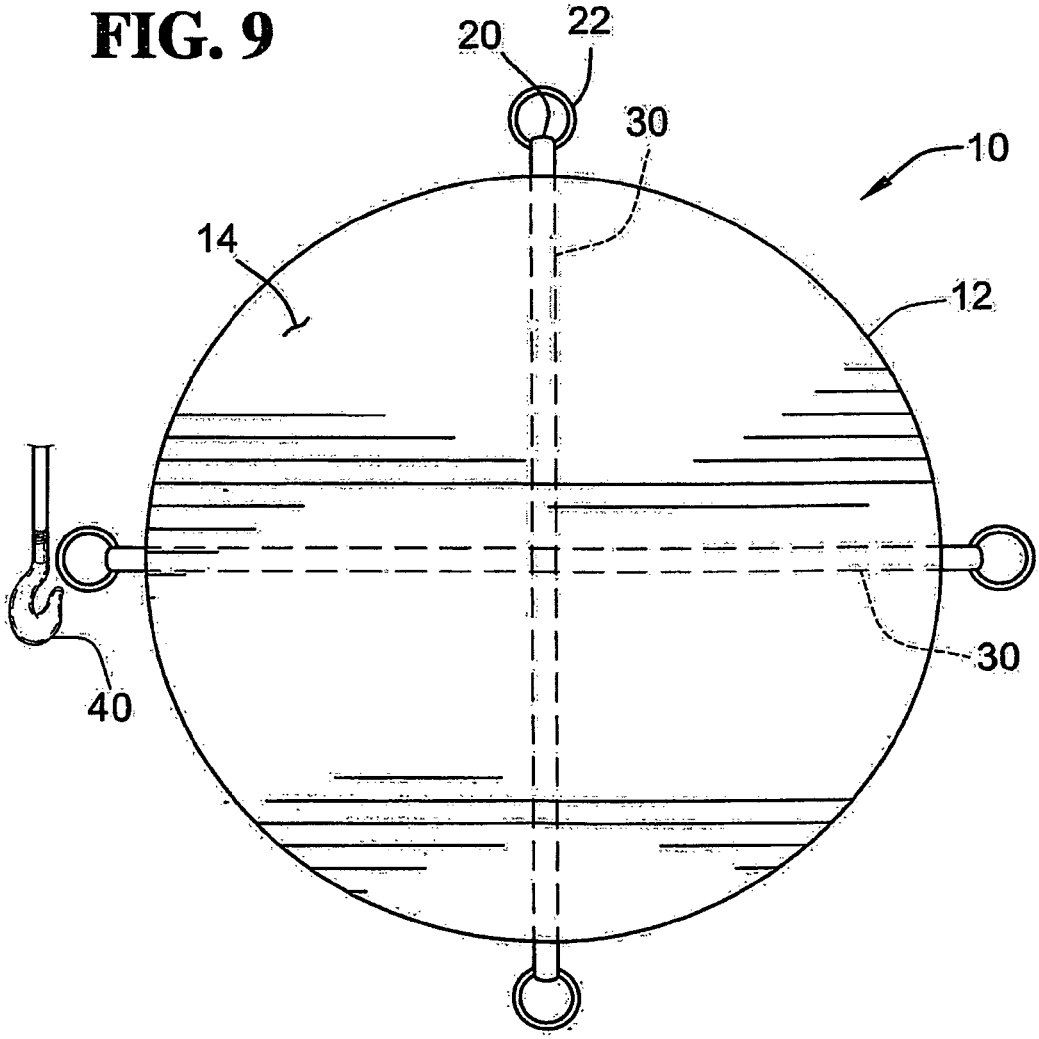
FIG. 9 is a top view of another embodiment of a cover described herein.

The cover 10 shown in FIGS. 3 and 4 highlights additional features of the cover 10. In these embodiments, a boundary of the flexible, substantially planar member 12 is folded over itself and is stitched to the bottom side 16 of the flexible, substantially planar member 12 to form a hem 24. A backing 26 is stitched over corners of the bottom side 16 of the flexible, substantially planar member 12 and associated portions of the reinforcing members 18. Preferably, the backing 26 is made of the same material as the flexible, substantially planar member 12. A support 28 connects the manipulation member 22 to the flexible, substantially planar member 12. In one embodiment, the support 28 is substantially strap-like in shape and passes through a center of the manipulation member 22. Both ends of the support 28 are attached to the bottom side 16 of the flexible, substantially planar member 12 by stitching. Preferably, the support 28 is made of the same material as the reinforcing members 18. In some embodiments, a material 30, such as plastic, rubber or silicon, is disposed between the bottom side 16 of the flexible, substantially planar member 12 and the plurality of the reinforcing members 18 to restrict a substance, such as water, dirt and the like, from becoming located between the bottom side 16 of the flexible, substantially planar member 12 and the plurality of reinforcing members 18. It is to be noted that any combination of reinforcing members 18, manipulation members 22, hems, backings 26 and/or supports 28 are possible to meet needs of a given application of the cover 10.

In use, the cover 10 is placed over a surface such that the bottom side 16 of the flexible, substantially planar member 12 contacts the surface. A material, such as snow, can accumulate on the top side 14 of the flexible, substantially planar member 12 thereby forming a load. To remove the accumulated snow from the surface, the manipulation members 22 are accessed. A lifter 40, such as a crane, a lift truck, a fork lift, a lever or other suitable device or person, is releasably connected with the manipulation members 22, and the lifter 40 applies force to the manipulation members 22 to raise the cover 10 and the load of accumulated snow off of the surface. In one embodiment, a joining member, such as a rope, a cable, a chain or the like, can be connected between the manipulation members 22 and the lifter to facilitate lifting of the load with the cover 10. Because the reinforcing members 18 reliably support the load, the load is removed from the surface by lifting the flexible, substantially planar member 12 with the lifter 40. The lifter 40 can deposit the load in an appropriate location.

In other uses of the cover 10, the lifter 40 can be releasably connected with a subset of the plurality of manipulation members 22. In this manner, the load can be redistributed, i.e. moved toward a center of the flexible, substantially planar member 12, to facilitate movement of the load with the cover 10. In this manner, likelihood of movement or spillage of the load during movement of the cover 10 can be reduced. Thus, after the lifter 40 is releasably connected with a subset of the plurality manipulation members 22 and the load is redistributed on the cover 10, i.e. moved toward a center of the cover 10, then, the lifter 40 is releasably connected with all of the manipulation members 22. The lifter 40 applies force to all of the manipulation members 22 to raise the cover 10 and the load of accumulated snow off of the surface.

What is claimed is:

1. A snow removal cover comprising:

(a) a substantially square shaped, flexible, substantially planar member including a water proof material, wherein a boundary of the flexible, substantially planar member is folded over itself and stitched to the bottom side of the flexible, substantially planar member to form a hem;

(b) a plurality of reinforcing members attached to the substantially square shaped, flexible, substantially planar member, the plurality of reinforcing members being arranged on the substantially square shaped, flexible, substantially planar member so that the substantially square shaped, flexible, substantially planar member can reliably support a load;

(c) a plurality of manipulation members operatively associated with the plurality of reinforcing members, the plurality of manipulation members being accessible to a lifter so that the lifter can apply force to the plurality of reinforcing members and move the load reliably supported by the substantially square shaped, flexible, substantially planar member; and (d) a support connecting each of the plurality of manipulation members with the substantially square shaped, flexible, substantially planar member, wherein both ends of the support are attached to the bottom side of the substantially square shaped, flexible, substantially planar member.

2. The cover as defined in claim 1 wherein the substantially square shaped, flexible, substantially planar member comprises at least one of 13 oz. material and 18 oz. material.

3. The cover as defined in claim 1 wherein the plurality of reinforcing members comprise 6000 lb. webbing.

4. The cover as defined in claim 1 wherein the plurality of manipulation members comprise bull rings.

5. A snow removal cover comprising:

(a) a flexible, substantially planar member including a water proof material, wherein a boundary of the flexible, substantially planar member is folded over itself and stitched to the bottom side of the flexible, substantially planar member to form a hem;

(b) a plurality of reinforcing members attached to the flexible, substantially planar member, the plurality of reinforcing members being arranged on the flexible, substantially planar member so that the flexible, substantially planar member can reliably support a load; and (c) a plurality of manipulation members operatively associated with the plurality of reinforcing members, a support connecting each of the plurality of manipulation members with the flexible, substantially planar member, wherein both ends of the support are attached to the bottom side of the flexible, substantially planar member, a backing stitched over the corners of the bottom side of the flexible, substantially planar member and associated portions of the reinforcing members, and the plurality of manipulation members being accessible to a lifter so that the lifter can apply force to the plurality of reinforcing members and move the load reliably supported by the flexible, substantially planar member.

6. The cover as defined in claim 5 wherein the flexible, substantially planar member is at least one of substantially square shaped, substantially circularly shaped, substantially rectangular and substantially elliptical.

7. A cover as defined in claim 5 wherein the flexible, substantially planar member comprises at least one of 13 oz. material and 18 oz. material.

8. A cover as defined in claim 5 wherein the plurality of reinforcing members comprise 6000 lb. webbing.

9. A cover as defined in claim 5 wherein the plurality of manipulation members comprise bull rings.

10. A cover as defined in claim 5 further comprising:

(d) a material disposed between the bottom side of the flexible, substantially planar member and the plurality of the reinforcing members to restrict a substance from becoming located between the bottom side of the flexible, substantially planar member and the plurality of reinforcing members.

11. A method of using a cover with a surface to remove snow, the method comprising the steps of:

(a) providing a cover having a flexible, substantially square shaped, planar member including a water proof material, a plurality of reinforcing members attached to the flexible, substantially square shaped, planar member, the plurality of reinforcing members being arranged on the flexible, substantially square shaped, planar member so that the flexible, substantially square shaped, planar member can reliably support a load of snow, a plurality of manipulation members operatively associated with the plurality of reinforcing members, and a support connecting each of the plurality of manipulation members with the flexible, substantially square shaped, planar member, wherein both ends of the support are attached to the bottom side of the substantially square shaped, flexible, substantially planar member, a backing stitched over the corners of the bottom side of the flexible, substantially planar member and associated portions of the reinforcing members;

(b) placing the cover on the surface;

(c) allowing the load of snow to accumulate on the cover;

(d) accessing the plurality of manipulation members with a lifter;

(e) applying a force to the plurality of reinforcing members with the lifter; and (f) moving the load reliably supported by the flexible, substantially planar member with the lifter.

12. The method as defined in claim 11, wherein the flexible, substantially square shaped, planar member includes a boundary of the flexible, substantially planar member is folded over itself and stitched to the bottom side of the flexible, substantially planar member to form a hem.

13. The method as defined in claim 11, wherein the flexible, substantially square shaped, planar member comprises at least one of 13 oz. material and 18 oz. material.

14. The method as defined in claim 11, wherein the plurality of reinforcing members comprise 6000 lb. webbing.

15. The method as defined in claim 11, wherein the plurality of manipulation members comprise bull rings.

16. A method of using a cover with a surface to remove snow, the method comprising the steps of:

(a) providing a cover having a flexible, substantially square shaped, planar member, a plurality of reinforcing members attached to the flexible, substantially square shaped, planar member, the plurality of reinforcing members being arranged on the flexible, substantially square shaped, planar member so that the flexible, substantially square shaped, planar member can reliably support a load of snow, and a plurality of manipulation members operatively associated with the plurality of reinforcing members, and a support connecting each of the plurality of manipulation members with the flexible, substantially square shaped, planar member, wherein both ends of the support are attached to the bottom side of the flexible, substantially square shaped, planar member, a backing stitched over the corners of the bottom side of the flexible, substantially square shaped, planar member and associated portions of the reinforcing members;

(b) placing the cover on the surface;

(c) allowing the load of snow to accumulate on the cover;

(d) accessing a subset of the plurality of manipulation members with a lifter;

(e) applying a force to the subset of the plurality of reinforcing members with the lifter; and (f) redistributing the load of snow on the flexible, substantially square shaped planar member with the lifter.

17. The method as defined in claim 16 further comprising the steps of:

(g) accessing the plurality of manipulation members with a lifter;

(h) applying a force to the plurality of reinforcing members with the lifter; and (i) moving the load of snow reliably supported by the flexible, substantially square shaped, planar member with the lifter.

18. The method as defined in claim 16, wherein the flexible, substantially square shaped, planar member includes a boundary of the flexible, substantially square shaped, planar member is folded over itself and stitched to the bottom side of the flexible, substantially square shaped, planar member to form a hem.

* * * * *